United States Patent [19]

Cline

[11] Patent Number: 4,632,087

[45] Date of Patent: Dec. 30, 1986

[54] ARCHERY ARROW SUPPORT DEVICE

[76] Inventor: Darrell W. Cline, 5227 Mays Branch, Lavalette, W. Va. 25535

[21] Appl. No.: 650,888

[22] Filed: Sep. 17, 1984

[51] Int. Cl.[4] ..... F41B 5/00

[52] U.S. Cl. ..... 124/41 A

[58] Field of Search ..... 124/23 R, 24 R, 41 A, 124/88, 35 A

[56] References Cited

U.S. PATENT DOCUMENTS

| | | | |
|---|---|---|---|
| 2,483,928 | 10/1949 | Ott | 124/41 A |
| 2,691,974 | 10/1954 | Nelson | 124/41 A |
| 2,975,780 | 3/1961 | Fisher | 124/41 A |
| 3,158,145 | 11/1964 | Handy | 124/41 A |
| 3,244,161 | 4/1966 | Jenson | 124/41 A |
| 3,285,237 | 11/1966 | Wolfe | 124/41 A |
| 3,461,852 | 8/1969 | Brothers | 124/41 A |
| 3,504,659 | 4/1970 | Babington | 124/41 A |
| 3,518,959 | 7/1970 | Bunker | 124/41 A |
| 3,788,299 | 1/1974 | Mathews | 124/35 R |
| 3,828,757 | 8/1974 | Finlay | 124/41 A |
| 3,935,854 | 2/1976 | Troncosco, Jr. | 124/24 R |
| 4,038,960 | 8/1977 | Ludwig | 124/41 A |
| 4,236,497 | 12/1980 | Troncoso, Jr. | 124/24 R |
| 4,287,868 | 9/1981 | Schiff | 124/41 A |
| 4,407,260 | 10/1983 | Lyons | 124/35 A |
| 4,421,092 | 12/1983 | Christian | 124/41 A |

*Primary Examiner*—Richard C. Pinkham
*Assistant Examiner*—Benjamin Layno
*Attorney, Agent, or Firm*—Lowe, Price, LeBlanc, Becker & Shur

[57] ABSTRACT

An improved arrow support device including a pair of arrow clamping jaws pivotally secured to a pivot frame connected along a vertical pivot axis to a support bracket attached to the bow. The pivot frame is spring-biased to a neutral position and rotatable by the archer so that the jaws can be manually pressed into contact with the arrow shaft. A clamping block and pin, engaging inclined surfaces of the jaws and carried by a rotatable pivot shaft supported on the frame, are pivoted towards each other in response to the manual rotation of the shaft to tightly clamp the jaws against the arrow. The arrow is further maintained in contact with the bow string by transmitting the spring bias of the pivot frame to urge the nocked end of the arrow against the bow string. To disengage the jaws, the shaft is manually rotated in the opposite direction so that the clamping block and pin slide back towards the pivot ends of the jaws allowing spring pressure to separate the jaws. As the jaws clear the arrow shaft surfaces, the spring bias of the pivot frame automatically pivots the support structure back to the predetermined neutral position. A spring tension adjustment screw is provided to vary the spacing of the spring biased upper jaw with respect to the lower jaw to accommodate arrows of different diameters.

1 Claim, 13 Drawing Figures

ARCHERY ARROW SUPPORT DEVICE

TECHNICAL FIELD

The present invention generally relates to devices used in archery to support an arrow on a side of a bow during target shooting and hunting and, more particularly, to a spring-loaded archery arrow support device for clamping an arrow to the bow and a bow string in a safe and ready position without applying appreciable tension to the bow string.

BACKGROUND ART

Archery bows are commonly used by sportsmen on hunting trips for killing game, such as deer. A popular approach used in hunting deer requires taking a stand at a single location in proximity to a deer run and waiting for the game to come within arrow range. Hunting in this manner usually requires prolonged waiting periods, during which time the hunter must remain mentally alert and relaxed. Above all, the hunter must remain in a quiet, stationary position to camouflauge his presence and avoid frightening the game.

One approach to meeting these requirements involves the use of a portable climbing tree stand, wherein a light-weight, rigid platform is attached to a tree by a support belt in a horizontal, elevated position above the ground. The hunter sits on the tree stand in a relaxed and ready position waiting for the game to enter the area. In this stance, the hunter must have his bow on the platform or resting against the tree. However, in either position it is often difficult for the archer to reach for his bow and fit an arrow thereto for firing in a rapid and quiet manner without frightening the deer.

To eliminate the aforesaid difficulty, archery arrow support devices are often used to clamp an arrow to the handle section of the bow with the nocked end provided with fletching fitted to the bow string. One type of arrow holder of which I am aware is disclosed in U.S. Pat. No. 3,158,145 to Handy wherein arrow gripping jaws carried by first and second pairs of links in a lazy tongue assembly attached to the bow are capable of clamping against the arrow by drawing the bowstring into a partially drawn position to lock the link assembly into a clamping position. A locking mechanism provided on the assembly is operable to release the jaws when the bow string is subsequently moved toward a fully drawn position from the partially drawn position.

One problem associated with this prior art support device is that the bowstring must be partially drawn to clamp the jaws against the arrow. This arrangement tends to be unsafe in the event that the bow or arrow is inadvertently dropped or bumped against a tree, possibly causing the locking mechanism to release the arrow with sufficient force to cause injury. Also, in the event that an archer is stalking game by moving through a hunting area, the requirement of partially drawing the bowstring to clamp the arrow in position increases the bulkiness of the bow and arrow, hampering the archer's progress through the woods. In addition, the aforesaid prior art device does not sufficiently spread the jaws apart to release the arrow, the jaws thus tend to contact the arrow fletching, adversely affecting the trajectory of flight.

Another type of arrow support device is disclosed in U.S. Pat. No. 2,691,974 to Nelson wherein a pair of rollers are mounted on a yoke fixed to a spring biased U-shaped lever allowing the rollers to clamp against the arrow without requiring the bow string to be either partially or fully drawn. By pushing on the lever against the bias of the spring, the rollers disengage the arrow and are pivoted 90° out of the arrow flight axis by means of a spring biased arm having an upper end journalled in a hub secured to the bow by means of a bracket. A pin provided within a recess of the hub limits the turning movement of the arm as it pivots to a neutral position.

While the aforesaid prior art arrow support device avoids some of the prior art problems discussed above, the arrangement of parts with the requirement that the holder project forward from the bow results in a somewhat bulky structure that may prevent the bow from being supported on various known types of holding bracket assemblies commonly used in conjunction with portable tree stands. In addition, the requirement of manually flipping the U-shaped lever to disengage the rollers from the arrow against the bias of the clamping spring so that the rollers can be pivoted by the hub spring through 90° to a neutral position requires the archer to apply continuous pressure to the U-shaped lever against the spring bias until the rollers clear the arrow. This release procedure can be somewhat time consuming. Also, should the archer release the U-shaped lever before the rollers clear the arrow, there is a tendency for the rollers to spring back into clamping position requiring repeated effort by the archer to release the rollers. Also, when the rollers spring back to clamping contact, noise generated is likely to frighten the deer. Even if the archer is successful in maintaining the lever in a partially rotated position against the spring bias so that the rollers clear the arrow, a loud clicking noise is generated as the hub pin rotates into contact with a wall of the recess to limit turning movement of the rollers, again possibly frightening deer that have just entered the area.

It is accordingly an object of the present invention to provide an arrow support device that is easily attachable to the handle portion of an archery bow to safely clamp an arrow to the bow and bowstring in a shooting position without transmitting appreciable tension to the bowstring.

Another object of the invention is to provide an arrow support device that is a compact structure positioned between the bow and bowstring to avoid interfering contact with external objects while permitting the archer to handle the bow as in normal use without interference.

Still another object is to provide an arrow support device that is quiet and rapid in operation to avoid frightening game.

Yet a further object is to provide a device that is easy for the archer to operate in clamping and unclamping the arrow to the bow.

DISCLOSURE OF INVENTION

An improved archery arrow support device, in accordance with the present invention, comprises a support bracket attached to the handle section of the bow and a pivot bracket pivotally connected to the support frame for pivotal movement about a first axis through 90° of travel. The pivot frame carries a pair of jaws capable of clamping against the arrow shaft to maintain the arrow along a longitudinal axis of intended arrow flight so that the arrow can be fitted in contact with a bowstring, ready for instantaneous use. The jaws are movable with the pivot frame about the first axis between a first position wherein the jaws intersect the longitudinal flight axis of the arrow for clamping engagement without transmitting appreciable tension to the bowstring and a second, predetermined neutral position wherein the jaws and pivot frame pivot about the first axis towards the bow through 90° so as to be sufficiently spaced to avoid interfering contact with the arrow being shot from the bow. Actuating means is provided for biasing the jaws into clamping engagement with the arrow and for unclamping the jaws. Movement of the actuating means by the archer into the unclamping position automatically causes the pivot frame and jaws to pivot into the predetermined neutral position.

In accordance with the preferred embodiment of the invention, the pivot frame is an L-shaped member having a pair of first and second vertical mounting portions extending generally orthogonal to each other. The first mounting portion extends generally parallel to the longitudinal arrow flight axis in the neutral position and is pivoted through 90° of travel relative to the support bracket into the shooting position. The jaws are vertically spaced from each other and pivotally connected at common pivot ends thereof to the inner surface of the first mounting portion. Opposite distal ends of the jaws project outward from the first mounting portion for pivotal movement in a plane extending parallel to the first portion. The distal ends have arrow gripping surfaces spaced from the pivot ends for proper positioning above and below the arrow when pivoted to the clamping position.

The clamping means preferably includes a spring positioned to normally bias the jaws apart from each other. The actuating means includes a jaw clamping mechanism having a pair of upper and lower members carried on a pivot shaft supported on the second mounting portion. The pivot shaft is rotatable about its longitudinal axis. The upper and lower members respectively engage upper and lower inclined surfaces of the jaws so that rotation of the pivot shaft in a first direction causes the upper and lower members to slide along the inclined surfaces towards the distal ends of the jaws. The jaws yield to movement of the upper and lower members and pivot towards each other for clamping against an arrow. A handle formed on the lower end of the pivot shaft is provided to rotate the shaft between clamping and unclamping positions. Since the pivot shaft is not resiliently biased in any direction, the handle does not have to be maintained by the archer in the unclamping position.

The pivot shaft is preferably supported on a base projecting horizontally between the first and second mounting portions. A side edge of the base is spaced from the inner surface of the first mounting portion to establish a gap in which the jaws are pivotally secured. Concave vertical grooves may be provided along the inner surface and side edge to safely retain the first spring biasing the jaws apart from each other.

In accordance with the invention, the upper member is preferably a clamping block. An upper end of the shaft projecting above and resting upon the base is an enlarged diameter or head portion formed with a notch for containing the clamping block. The clamping block is pivotally secured at one end thereof facing away from the jaws to a corresponding end of the notch. A second spring positioned within the notch presses upwards against the clamping block to urge the block against a retaining member covering the notch so that the distal end of the block in contact with the upper jaw is movable in a horizontal plane of travel to pivot the jaws upon co-rotation of the lower member via engagement with the inclined surfaces of the jaws.

The maximum spacing between the jaws is determined by the spacing between the clamping block and clamping pin on the pivot shaft. In accordance with a further aspect of the invention, the elevational position of the distal end of the clamping block is adjustable by means of a spring tension adjustment screw passing through the block and spring for threaded engagement with the bottom of the notch. By rotating the screw, the compression force of the second spring is adjusted, causing the distal end of the clamping block to pivot into a different elevational position. Since the upper jaw is maintained by the first spring in constant contact with the clamping block, the spacing of the jaws is thereby adjusted.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWING

FIGS. 10 and 11 are views similar to FIGS. 8 and 9, respectively, showing the unclamped jaws spaced by adjustment means to accomodate large diameter arrows or the like;

BEST MODE FOR CARRYING OUT THE INVENTION

Figure 1:
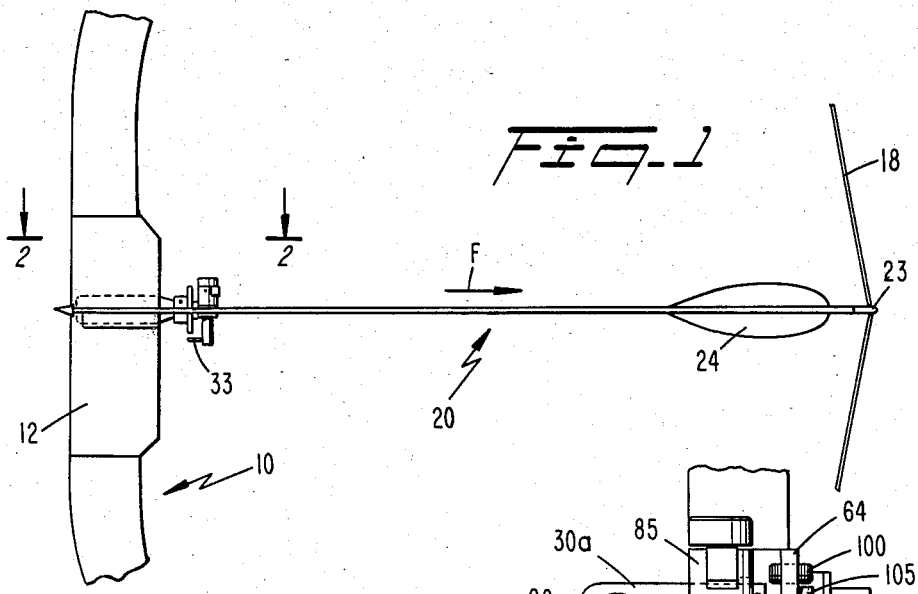
FIG. 1 is a side elevational view of an arrow support device according to the present invention, showing the jaws clamping an arrow to the archery bow.

Referring to FIGS. 1–4, an archery bow 10 includes a gripping portion 12 having a site window 14 formed therein defining a ledge or shelf 16 extending transversely of the bow. A bow string 18 is shown in a relaxed position with an arrow 20 nocked thereon. Arrow 20 is provided with a forward end 22 (e.g., pointed, barbed, etc.) and a notched rear end 23 engaging bow string 18. The rear end includes fletching 24.

Figure 3:
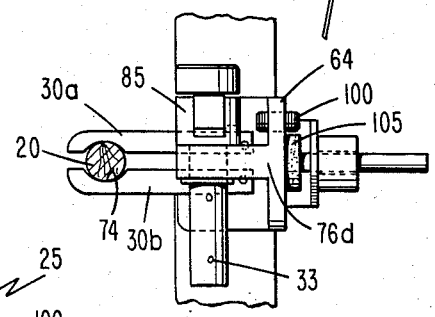
FIG. 3 is a right side elevational view of the support device in FIG. 1.
Figure 4:
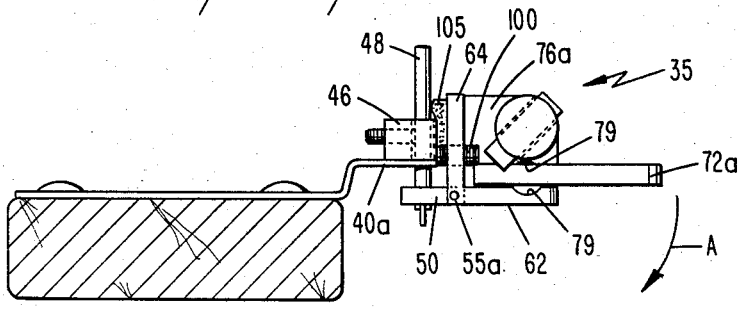
FIG. 4 is a view similar to FIG. 2 showing the support device in the neutral position.

To maintain arrow 20 in a shooting position ready for instantaneous use, arrow support device 25 of the present invention basically comprises a mounting bracket assembly 27 secured to bow 10 above grip 12, to which is pivotally attached a pivot frame 29 carrying a pair of arrow gripping arms or jaws 30*a*, 30*b*. The pivot frame 29 and jaws 30*a*, 30*b* are normally biased out of the flight path of arrow 20, as best depicted in FIG. 4. However, to mount arrow 20 to bow 10 with the invention, subsequent to fitting notched end 23 to bow string 18 and placing the forward portion of arrow 20 to rest upon shelf 16, the archer pivots the jaws 30*a*, 30*b* in the direction of arrow A so that they respectively extend orthogonal to above and below the arrow. The jaws 30*a*, 30*b* are then respectively grasped by the archer with the fingers of one hand (not shown) and pivoted towards each other into contact with the arrow (FIG. 3). By rotating a small actuating handle 33 in counterclockwise direction B (FIGS. 8 and 9) which controls a jaw clamping mechanism 35 discussed below, the jaws pivot together and are locked into clamping engagement with arrow 20 while imparting a rearwardly directed spring force F transmitted from bracket 27 to pivot frame 29 to retain the notched end 23 in engagement with bow string 18 and thereby allow the arrow to be fitted to the bow for instantaneous use.

Figure 7:
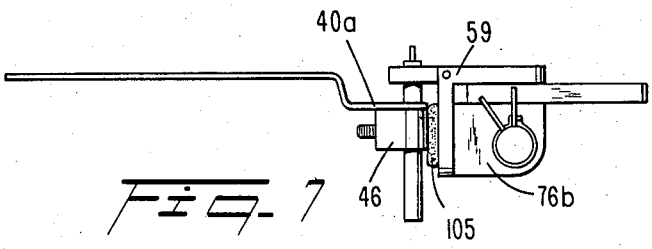
FIG. 7 is a bottom view of the device shown in FIG. 5.

Generally, the archer sits on a tree stand (not shown) in a relaxed and ready position waiting for game to enter the area. Bow 10 with arrow 20 fitted therein is positioned in easy reach of the archer. Upon sighting game, the archer grasps the bow and arrow as in normal use. By rotating handle 33 in clockwise direction B', clamping mechanism 35 is released to allows jaws 30*a*, 30*b* to automatically pivot out of contact with the arrow (e.g., from the FIG. 9 to 8 positions) as jaws 30*a*, 30*b* disengage the arrow, the spring force F automatically rotates the pivot frame 29 and jaws back towards the bow into a neutral position (FIG. 7) out of the flight path of arrow 20.

Figure 2:
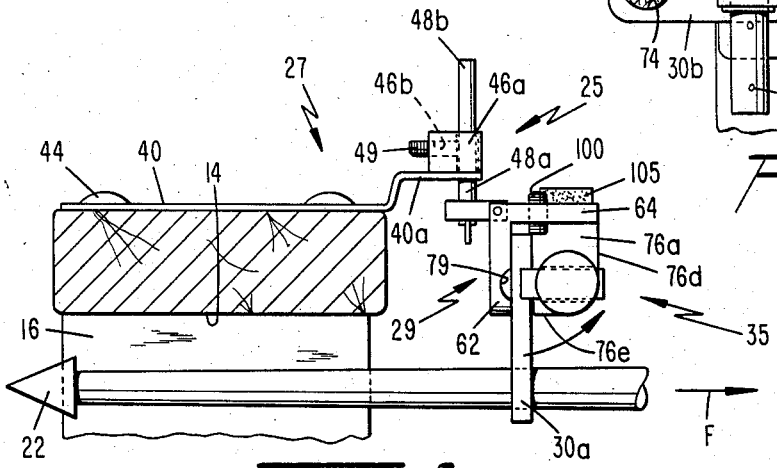
FIG. 2 is an enlarged top view of the support device showing the jaws in clamping engagement with the arrow.

Referring to FIG. 2, mounting bracket assembly 27 includes a flat rectangular bracket portion 40 having a pair of holes 42 receiving screws 44 for securing the bracket to the bow. Bracket 40 includes, at a rearwardly extending end thereof, a parallel offset mounting flange 40*a* that projects towards the bow string 18. A collar 46 is fixed to flange 40*a* and has a first hole 46*a* slidably receiving a horizontal mounting pin 48, and a second threaded hole 46*b* formed orthogonal and intersecting the first hole. A set screw 49, threadedly received in hole 46*b*, bears against pin 48 to fixedly secure it to the flange. The pin 48 extends orthogonal to both flange 40*a* and arrow 20 and is divided by the flange into an end portion 48*a* extending inward towards the arrow and an outward directed portion 48*b*. A vertical mounting plate 50 (FIGS. 4 and 5) fixed to inwardly extending end 48*a* pivotally supports the pivot frame 29 and thereby jaws 30*a*, 30*b* as described more fully below.

Figure 5:
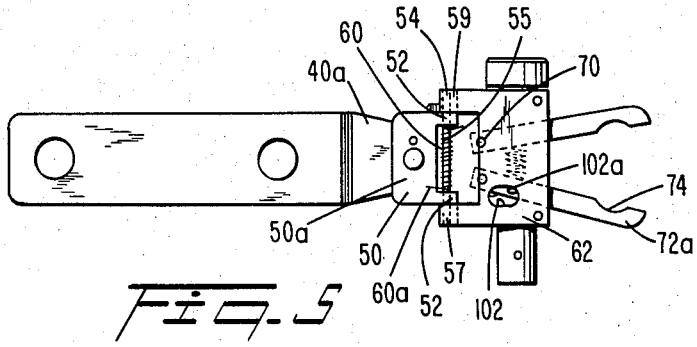
FIG. 5 is an enlarged side elevational view of the support device.

A pair of vertically spaced parallel arms 52, integrally formed on plate 50, are provided for attaching pivot frame 29 to bracket 40. As shown in FIG. 5, a pair of vertically aligned holes 54 are respectively formed in arms 52 to receive opposite ends 55*a* of a pivot pin 55. These opposite ends 55*a* project completely through holes 54 and are respectively and rotatably journalled in holes 57 formed in mounting ears 59 of pivot frame 29, as described infra, for pivotally attaching the pivot frame to the bracket. A spring 60 mounted on pin 55 between arms 52 has one end 60*a* bearing against an inwardly directed face 50*a* of plate 50 and an opposite end 60*b* bearing against the pivot frame. The spring 60 normally biases the pivot frame and thereby jaws 30*a*, 30*b* out of the flight path of arrow 20 into the neutral position shown in FIG. 4. By pivoting the support frame 29 through 90° about pin 55 against the bias of spring 60 into the FIG. 2 operating position, the jaws are positioned to clamp the arrow in the manner described above. Spring 60 is thus compressed to impart force F acting to retain arrow 20 in the ready position against bow string 18.

Figure 12:
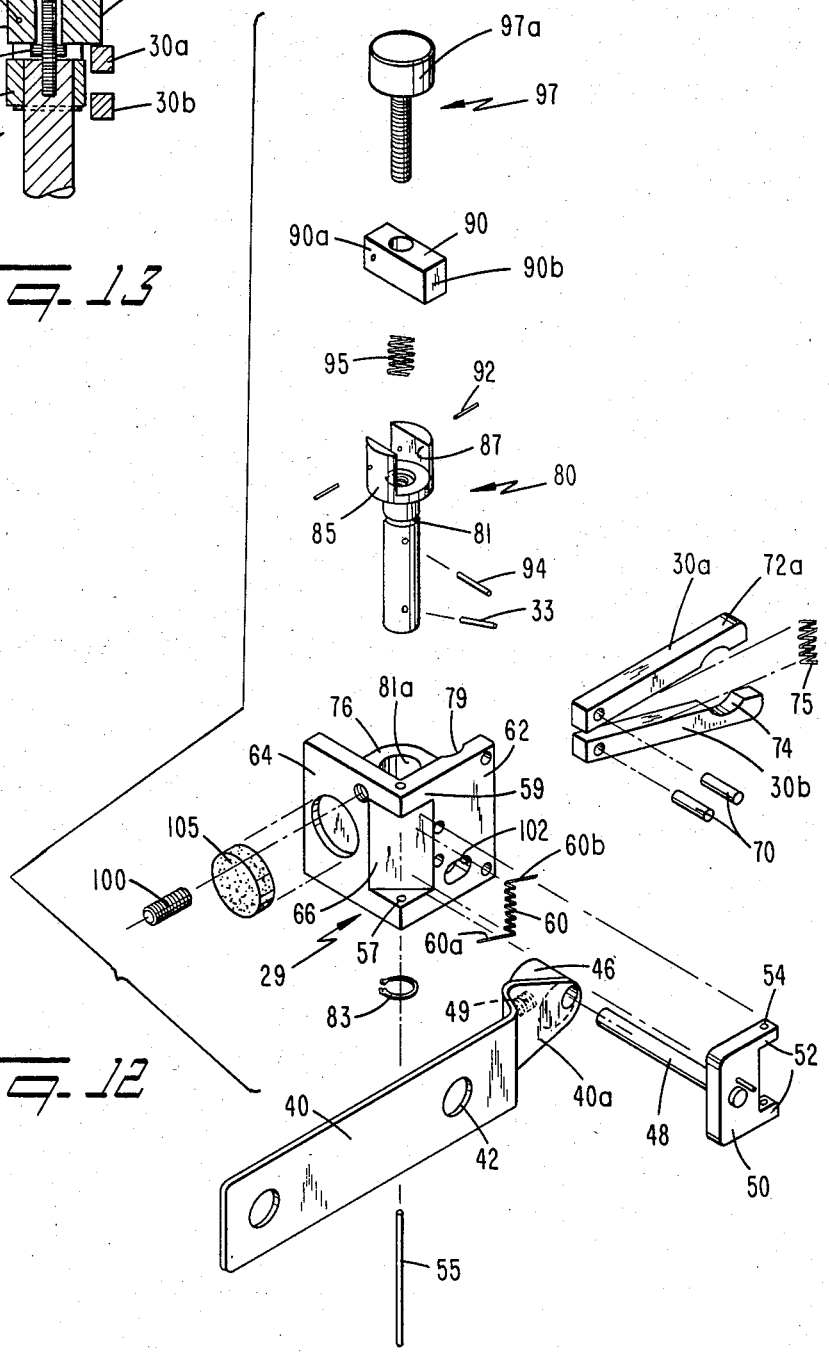
FIG. 12 is an exploded perspective view of the arrow support device of the invention.

Pivot frame 29 is a rigid L-shaped member (FIGS. 4 and 12) formed with a pair of orthogonal, vertical support portions 62 and 64 between which is mounted jaws 30*a*, 30*b* and jaw clamping mechanism 35. The flat rectangular portions 62, 64 integrally formed with each other, are preferably fabricated of a thin rigid material (such as metal). As best shown in FIG. 12, the mounting ears 59 respectively formed at upper and lower corners established by intersecting parts of portions 62, 64. The ears 59 are spaced apart from each other to define side walls of an outwardly directed recess 66 that may be formed by milling a part of the intersecting portion located between the ears. Recess 66 is of sufficient width to receive arms 52 of mounting plate 50 so that holes 54, 59 are coaxially aligned to interlock the pivot frame to the mounting plate with pivot pin 55. In addition, recess 66 is of sufficient depth so that the mounting ears 59 do not contact the bottom of the recess, allowing pivot frame 29 to smoothly and quietly pivot about pin 55 without any clicking sound.

Figure 8:
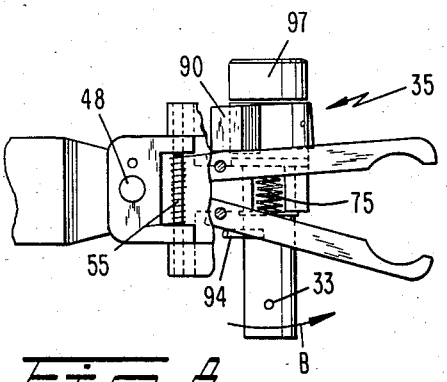
FIG. 8 is a partial sectional view taken along the line 8—8 of FIG. 6 showing the jaws in an unclamped position.
Figure 9:
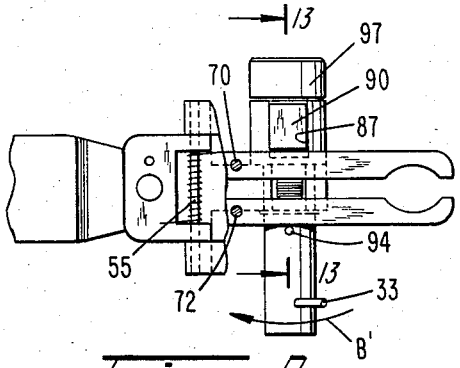
FIG. 9 is a view similar to FIG. 8 showing the jaws in a clamping position.

The arrow gripping jaws 30*a*, 30*b* are pivotally secured at common ends thereof to the vertical inner surface of support 62 with a pair of pivot pins 70. Distal ends 72*a* of jaws 30*a*, 30*b* respectively formed with concave surfaces 74 facing each other to grip arrow 20 as described infra, are vertically spaced apart and project outwardly from support portion 62 a sufficient distance so that they are properly situated to contact the arrow shaft when pivot frame 29 is rotated by the archer into the clamping position (see FIG. 2). A spring 75 is provided between opposite ends of jaws 30*a*, 30*b* to pivot the jaws (i.e., concave surfaces 74) about pivot pins 70 into a maximum outwardly angled, spread apart position (FIG. 8). In this position, jaws 30*a*, 30*b* can be pivoted, together with pivot frame 29, about pin 55 in the direction of arrow A towards the clamping position without inadvertently contacting the arrow shaft. Thereafter, jaws 30*a*, 30*b* are then respectively grasped by the archer with the fingers of one hand and pivoted towards each other about pins 70 into contact with the arrow 20. By manually rotating handle 33, as discussed briefly above, jaw clamping mechanism 35 urges the jaws into tight clamping engagement with arrow 20.

Figure 6:
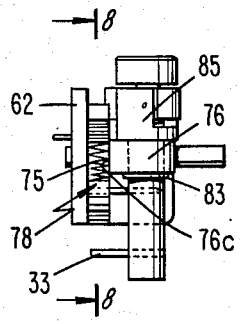
FIG. 6 is a right side elevational view.

The jaw clamping mechanism 35 is mounted between vertical support portions 62, 64 on a horizontal rectangular mounting base portion or shelf 76 that projects inward from support portion 64. The base portion 76 includes horizontal top and bottom surfaces 76*a*, 76*b*, vertical side edges 76*c* and 76*d* and an end surface 76*e*. The vertical side edge 76*c* extends parallel to the inner surface of support portion 62 to define therewith a gap 78 (FIG. 6) receiving portions of jaws 30*a*, 30*b* formed adjacent the pivot ends 72. Gap 78 is of sufficient width to enable the pivot end portions of jaws 30*a*, 30*b* to smoothly enter therein as the jaws are pivoted together.

Spring 75 is located within gap 78. Preferably, a pair of vertical concave grooves 79 (FIG. 4) facing each other are respectively formed on the inner surface of support portion 62 and edge 76c to receive and retain spring 75 within the gap. This retaining arrangement assures that spring 75 functions as a quick release mechanism when clamping mechanism 35 is actuated to unclamp the jaws from arrow 20 so that the jaws can rapidly pivot to the maximum, spread apart position enabling pivot frame 29 to rotate back to the neutral position.

Figure 13:
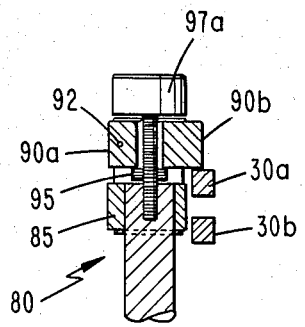
FIG. 13 is a sectional view taken along the line 13—13 of FIG. 9, showing the mechanism for adjusting the spacing between the jaws.

Jaw clamping mechanism 35 further includes a pivot shaft 80 projecting vertically through an aperture 81a formed in mounting base 76 (FIGS. 12 and 13). The shaft is so maintained axially immovable and rotatably secured to mounting base 76 by means of a snap ring 83 engaging bottom surface 76b of the base and a notched head 85 integrally formed at the upper end of the shaft in sliding contact with the top surface 76a. Snap ring 83 is seated within an annular groove 81 formed on shaft 80. Handle 33 extends transversely from the lower end of shaft 80 below jaws 30a, 30b to manually rotate the pivot shaft without interference from the jaws.

Figure 10:
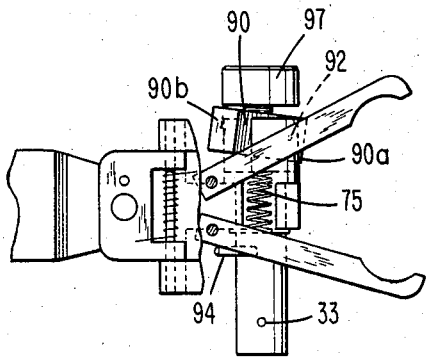

To clamp jaws 30a, 30b to arrow 20, head 85 includes an upwardly directed notch 87 in which is mounted a rectangular clamping block 90. As best depicted in FIGS. 10 and 13, block 90 has one end 90a pivotally secured to an outer end of notch 87 by means of a pivot pin 92. The opposite or distal end 90b of block 90 projects horizontally from the inner end of the notch to contact an upper surface of upper jaw 30a (FIGS. 8–10) a horizontal clamping pin 94, having one end fixed to vertical shaft 80 below snap ring 83, also projects horizontally in the same vertical plane as block 90 to engage the lower surface of lower jaw 30b. Thus, by rotating handle 33 in a counterclockwise direction B (when viewing head 85 from the top) corresponding rotation of shaft 80 about its longitudinal axis causes co-rotation of both block 90 and clamping pin 94. Since the upper and lower surfaces of jaws 30a, 30b are oppositely inclined with respect to each other and the horizontal plane of travel of both block 90 and pin 94 in respective contact therewith, it will now be appreciated that counterclockwise rotation of handle 33 causes jaws 30a, 30b to pivot towards each other into clamping engagement with arrow 20 by yielding to the pressing contact of the clamping block and pin therewith.

Figure 11:
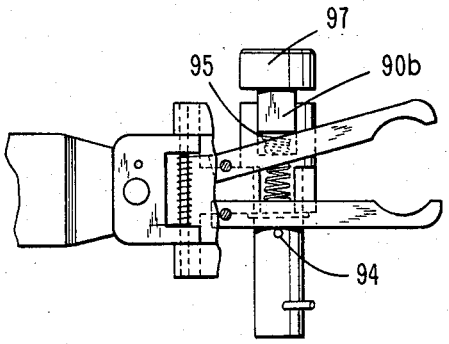

To transmit a clamping force to jaws 30a, 30b, a spring 95 (FIGS. 11–13) is provided within notch 87 between the bottom wall thereof and clamping block 90. More specifically, as best shown in FIG. 13 spring 95 is mounted between pivot pin 92 (i.e., the outer end of block 90) and the distal end 90b of the block by means of a spring force adjustment screw 97 passing vertically through the block and spring into threaded contact with the bottom of the notch. The spring 95 transmits an upwardly directed force urging distal end 90b against the lower surface of a head 97a of adjustment screw 97. The lower surface of distal end 90b is thus maintained by spring 95 in a constant horizontal plane of travel so that in response to rotation of handle 33 in the clamping direction as discussed supra, the distal ends of both the clamping block and pin 94 are positively rotated into smooth sliding contact with the upper and lower surfaces of 30a, 30b, respectively, to depress the jaws into tight clamping engagement with arrow 20. Once the jaws are tightly clamped to the arrow, both clamping block 90 and the clamping pin are maintained in tight press fitting contact with the upper and lower contact surfaces of the jaws, without slippage, by means of spring 75 in gap 78 biasing the jaws against these clamping members without affecting the clamping action.

Stop means is preferably provided to maintain clamping members 90, 94 in constant engagement with jaws 30a, 30b so that adjustment of the spacing between the jaws is instantaneously responsive to rotation of handle 33. Such stop means is preferably a set screw 100 passing horizontally through mounting portion 64 of pivot frame 29 within the plane of travel of clamping block 90. The set screw 100 is engageable with block 90 when the latter is rotated with handle 33 into the neutral position; i.e., jaws 30a, 30b are in the maximum spread apart position, to prevent the block from being rotated out of contact with the upper surface of jaw 30a. Further, by rotating set screw 100 to vary the extent to which it projects toward block 90, the maximum spacing between jaws 30a, 30b can be adjusted to a certain extent.

To prevent clamping members 90, 94 from disengaging the surfaces of jaws 30a, 30b as they are rotated with handle 33 into the clamping position, an elongated horizontal slot or aperture 102 is formed in support portion 62. The slot 102 as best depicted in FIG. 5, extends in the horizontal plane of travel of clamping pin 94 to receive the pin as it rotates towards the clamping position without interfering contact with the pivot frame 29. An outer end 102a of slot 102 contacts the pin 94 to prevent overtravel thereof.

It will be appreciated that although set screw 100 and elongated slot 102 are preferred forms for limiting the degree of rotational movement of clamping members 90, 94 as described above, other types of stop means can be provided to accomplish a similar purpose. For example, set screw 100 can be replaced by a projection (not shown) integrally formed on the inner surface of mounting portion 64 to contact block 90. A second projection (also not shown) can be formed integral with the inner surface of mounting portion 62 to also contact block 90 as it rotates towards the clamping position. In this alternative arrangement, elongated slot 102 can be dispensed with and clamping pin 94 can be shortened to avoid contact with the mounting portion 62 while engaging jaw 30b. However, set screw 100 and elongated slot 102 are preferred so that the dimensional tolerances involved with cutting block 90 and pin 94 into their desired lengths becomes less critical and is less expensive to fabricate than the aforesaid projections (not shown) integrally formed on inner surfaces of portion 62, 64.

The spring force adjustment screw 97 of the invention uniquely allows for easy adjustment of the spacing between jaws 30a, 30b (i.e., concave surfaces 74) so that arrow support 10 can accommodate arrows of different diameters. This adjustable spacing is achieved in the preferred embodiment by virtue of locating spring 95 in the manner described above to press clamping block 90 upward into contact with the head of screw 97. Since adjustment spring 95 is further located between pivot end 90a of block 90 and distal end 90b thereof, rotation of the adjustment screw head in the counterclockwise direction (i.e., unfastening) enables spring 95 to press block 90 upwards against the screw head (FIG. 10). Thus, the lower contact surface of block 90 is elevated under the force of spring 95 causing corresponding movement of upper jaw 30a under the action of spring 75 located between the jaws. In this manner, the maximum separation between the jaws is increased to accommodate larger diameter arrows.

To decrease the separation between the jaws to accommodate smaller diameter arrows, the head of adjustment screw 97 is turned in the clockwise or fastening direction. The lower surface of the head thus presses downwardly against clamping block 90 to urge distal end 90*b* thereof in the downward direction. The upper jaw 30*a* yields to downward pivotal movement of the clamping block to decrease the separation between the jaws.

To minimize objectionable clicking noise likely to occur as the entire pivot frame 29 and jaws 30*a*, 30*b* pivot towards the neutral position into contact with mounting bracket assembly 27, a cushion pad 105 may be provided on the outer surface of mounting portion 64 having a tendency to strike either collar 46 and/or mounting pin 48.

The foregoing description of the preferred embodiment of the invention has been presented for purposes of illustration and description. It is not intended to be exhaustive or to limit the invention to the precise form disclosed, and obviously many modifications and variations are possible in light of the above teaching. The embodiment is chosen and described in order best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. An arrow support device for maintaining an arrow to be shot from an archery bow along a longitudinal axis of intended arrow flight so that the arrow can be fitted in contact with a bow string at a nocking point and be supported on said bow with said device clamping against the arrow shaft without further intervention by the archer, said device being adapted for mounting on the handle section of the archery bow, said device comprising:

(a) a support bracket attachable to the handle section of the bow;

(b) a pivot frame pivotally connected to the support bracket along a first axis;

(c) clamping means connected to the pivot frame for clamping against said arrow shaft, said clamping means including a pair of jaws movable with said pivot frame about the first axis between (1) a first position wherein the jaws intersect the longitudinal flight axis of the arrow for clamping engagement with the arrow without transmitting appreciable tension to the bow string and (2) a second predetermined neutral position wherein the jaws and pivot frame pivot about the first axis so as to be sufficiently spaced to avoid interfering contact with the arrow as said arrow is being shot from said archery bow; and (d) actuating means for (1) biasing said jaws into clamping engagement with said arrow, and (2) disengaging the jaws from said clamping engagement, wherein movement of said actuating means by the archer to disengage the jaws automatically causes the pivot frame and jaws to pivot into said predetermined neutral position, further including adjustment means for varying the spacing between said jaws to thereby enable said jaws to grip arrows of different diameters, wherein said pivot frame is an L-shaped member having a pair of first and second mounting portions extending generally orthogonal to each other, said first mounting portion extending generally parallel to the longitudinal arrow flight axis in the neutral position and being pivotal through 90° of travel relative to the support bracket into the first position, wherein said pair of jaws are vertically spaced from each other and pivotally connected at common or pivot ends thereof to the inner surface of the first mounting portion, opposite distal ends of said jaws projecting outward from the first mounting portion for pivotal movement in a plane extending parallel to the first portion, said distal ends having arrow gripping surfaces spaced from the pivot ends for proper positioning above and below the arrow when pivoted to the first position, wherein said clamping means further includes a spring positioned to normally bias the jaws apart from each other, and said actuating means includes a jaw clamping mechanism having a pair of upper and lower members carried on a pivot shaft supported on the second mounting portion, said pivot shaft being rotatable about its longitudinal axis, said upper and lower members respectively engaging upper and lower inclined surfaces of the jaws so that rotation of said pivot shaft in a first direction causes the upper and lower members to slide along said inclined surfaces towards the distal ends, thereby causing the jaws to yield to movement of said upper and lower members and pivot towards each other for clamping against an arrow.

* * * * *